US006457987B1

(12) United States Patent
Yeh

(10) Patent No.: US 6,457,987 B1
(45) Date of Patent: Oct. 1, 2002

(54) PLUG CONNECTOR WITH LATCH MECHANISM

(75) Inventor: Joel J. Yeh, Diamond Bar, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/952,910

(22) Filed: Sep. 14, 2001

(51) Int. Cl.[7] ..... H01R 13/62
(52) U.S. Cl. ..... 439/352
(58) Field of Search ..... 439/352, 358, 439/357, 76.1

(56) References Cited

U.S. PATENT DOCUMENTS 5,558,534 A * 9/1996 Sarkady et al. ..... 439/352
5,634,809 A * 6/1997 Hirai ..... 439/352
5,951,317 A * 9/1999 Tracy et al. ..... 439/352
5,954,531 A * 9/1999 Jennings et al. ..... 439/352
6,080,004 A * 6/2000 Kovacik et al. ..... 439/352
6,113,413 A * 9/2000 Cronin et al. ..... 439/352
6,319,040 B1 * 11/2001 Chang ..... 439/352
6,346,002 B1 * 2/2002 Hsu et al. ..... 439/352

* cited by examiner

*Primary Examiner*—Gary R Paumen
(74) *Attorney, Agent, or Firm*—Wei Te Chung

(57) ABSTRACT

A plug connector (8) includes a top cover (1), a latch mechanism (2), a strain relief (3) securing a cable (31), a terminal module (4) have a plurality of terminals (40) therein, a push button switch (5), a printed circuit board (6), and a bottom cover (7). The top cover has a latch release button (16). The latch mechanism includes a spring plate (20) and a latch portion (22) extending downwardly and outwardly from a front end of the spring plate. When the latch release button is pressed, the spring plate gets pressed, and the latch portion is moved downwardly and released from a mating connector. The plug connector is thus unlatched from the mating connector.

2 Claims, 4 Drawing Sheets

PLUG CONNECTOR WITH LATCH MECHANISM

BACKGROUND OF THE INVENTION

1. Field of the Invention

The present invention relates to plug connectors, and particularly to plug connectors with latch mechanisms latching the connectors to complementary mating connectors.

2. Related Art

A plug connector usually has a latch device for latching to a complementary mating connector. Generally, a conventional latch device includes two separate latch arms positioned on two sidewalls of a housing of the plug connector respectively. An example of this kind of plug connector is disclosed in U.S. Pat. No. 5,558,534. By pressing a press device on the plug connector, the latch arms are unlatched from the mating connector. The plug connector can then easily be separated from the mating connector. However, the structure of the plug connector is complicated, and it is difficult to assemble the latch device in the plug connector.

Another kind of conventional latch device has a separate latch and spring plate. A press device is pressed, which actuates the spring plate to press the latch. The latch is thus released from a mating connector. Such latch device is complicated, and results in high manufacturing costs. In addition, the spring plate does not always accurately depress the latch. Thus the plug connector cannot always be successfully separated from the mating connector.

Hence, a plug connector with an improved latch mechanism is desired to overcome the above problems.

SUMMARY OF THE INVENTION

An object of the present invention is to provide a plug connector with a latch mechanism integrating a latch portion and a spring plate together whereby the latch mechanism can be easily formed and easily assembled to the plug connector, thereby reducing costs.

Another object of the present invention is to provide a plug connector wherein latching and unlatching of the plug connector with and from a mating connector is reliable.

A further object of the present invention is to provide a plug connector with a latch mechanism wherein the latch mechanism is integrally formed with a crimping tail to securely connect a cable to the plug connector.

To achieve the above objects, a plug connector in accordance with a preferred embodiment of the present invention includes a top cover, a latch mechanism, a strain relief securing a cable, a terminal module have a plurality of terminals therein, a push button switch, a printed circuit board, and a bottom cover. The top cover has a latch release button. The latch mechanism includes a spring plate and a latch portion extending downwardly and outwardly from a front end of the spring plate. When the latch release button is pressed, the spring plate gets pressed, and the latch portion is moved downwardly and released from a mating connector. The plug connector is thus unlatched from the mating connector.

These and additional objects, features and advantages of the present invention will become apparent after reading the following detailed description of a preferred embodiment of the invention taken in conjunction with the appended drawings.

DETAILED DESCRIPTION OF THE INVENTION

Figure 1:
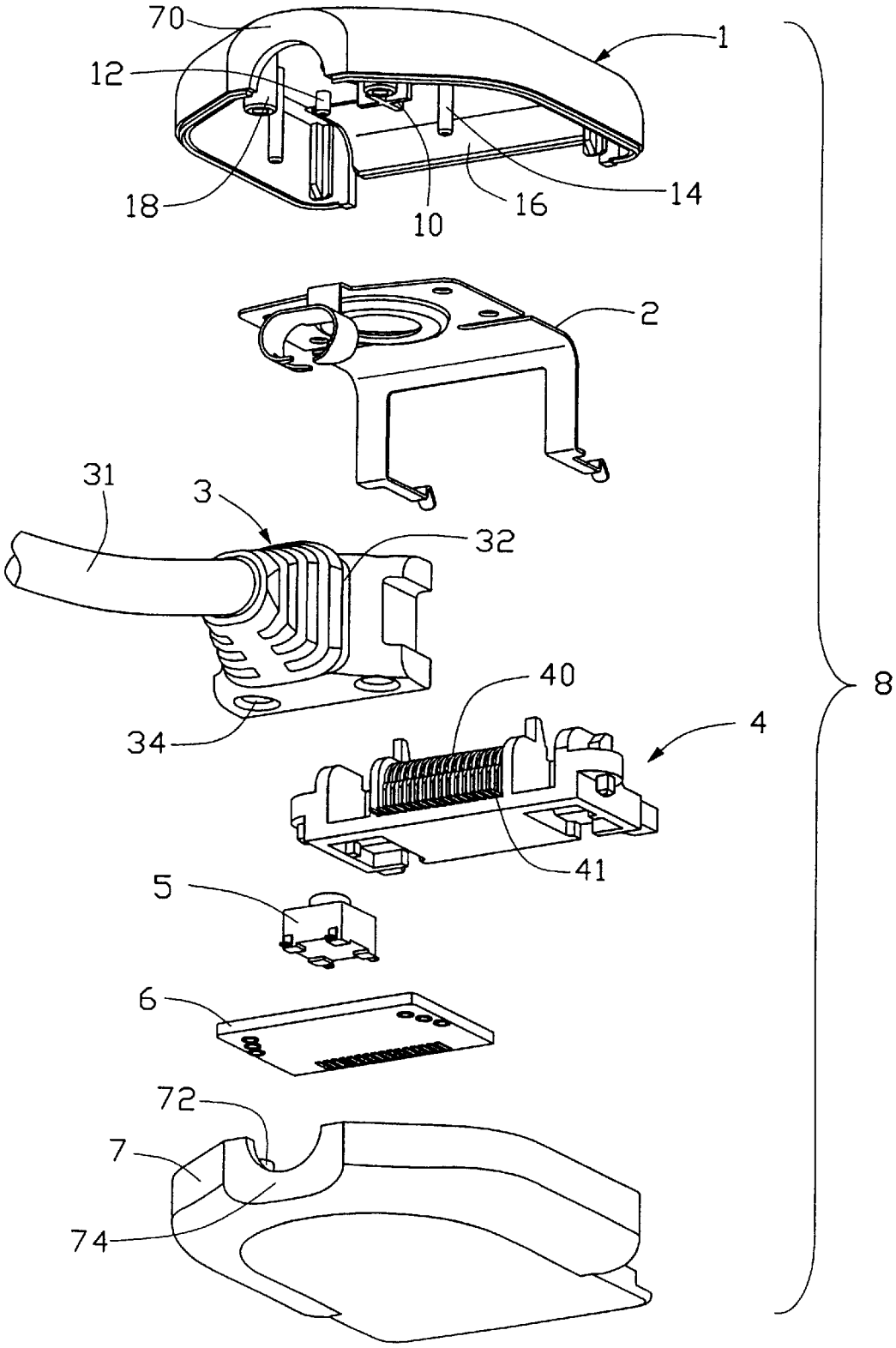
FIG. 1 is an exploded perspective view of a plug connector according to the present invention.
Figure 4:
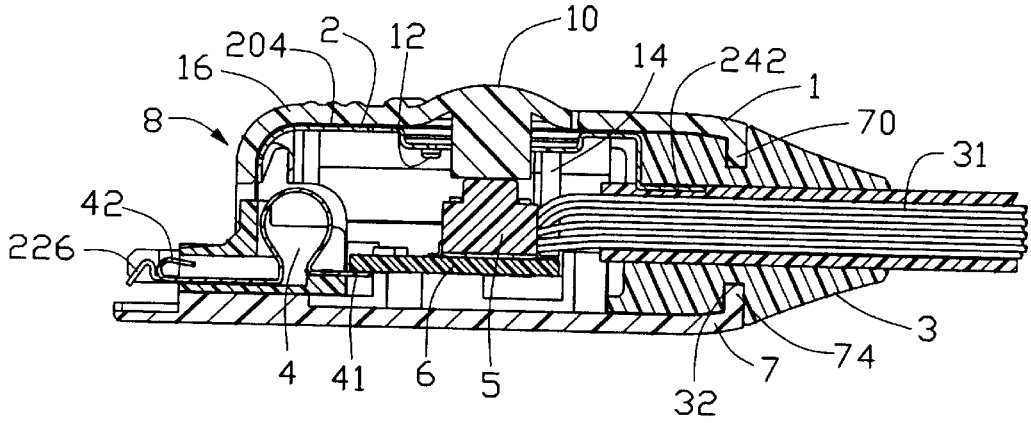
FIG. 4 is a cross-sectional view of the plug connector of FIG. 3, taken along line IV—IV of FIG. 3.

Referring to FIGS. 1 and 4, a plug connector 8 in accordance with a preferred embodiment of the present invention includes a top cover 1, a latch mechanism 2, a strain relief 3 securing a cable 31, a terminal module 4 have a plurality of terminals 40 therein, a push button switch 5, a printed circuit board 6 and a bottom cover 7.

The top cover 1 has a push button 10 depending from a central portion of a lower face thereof. Two short positioning poles 12 and two long positioning poles 14 depend from the lower face of the top cover 1 around the push button 10. The short positioning poles 12 are in front of the push button 10, and the long positioning poles 14 are behind the push button 10. A latch release button 16 is formed at a junction of a front end and part of a top of the top cover 1. A profile of the latch release button 16 is generally L-shaped. A pair of top studs 18 depends from a rear portion of the lower face of the top cover 1. A top flange 70 is formed at a rear end of the top cover 1.

The terminal module 4 is accommodated on the bottom cover 7. Each terminal 40 of the terminal module 4 includes a soldering portion 41 and a contact portion 42 (see FIG. 4). Each soldering portion 41 extends inwardly from the terminal module 4, for soldering to the printed circuit board 6. Each contact portion 42 is disposed outwardly from the terminal module 4, for engaging with a corresponding terminal (not shown) of a complementary mating connector (not shown).

The bottom cover 7 has a pair of bottom studs 72 extending upwardly from a rear portion of an upper face thereof. A bottom flange 74 is formed at a rear end of the bottom cover 7, corresponding to the top flange 70 of the top cover 1.

The strain relief has a pair of vertical receiving holes 34 defined through opposite sides of a head (not labeled) thereof. An annular groove 32 is defined in the strain relief 3 at a rear of the head, for receiving the top and bottom flanges 70, 74 of the top and bottom covers 1, 7.

Figure 2:
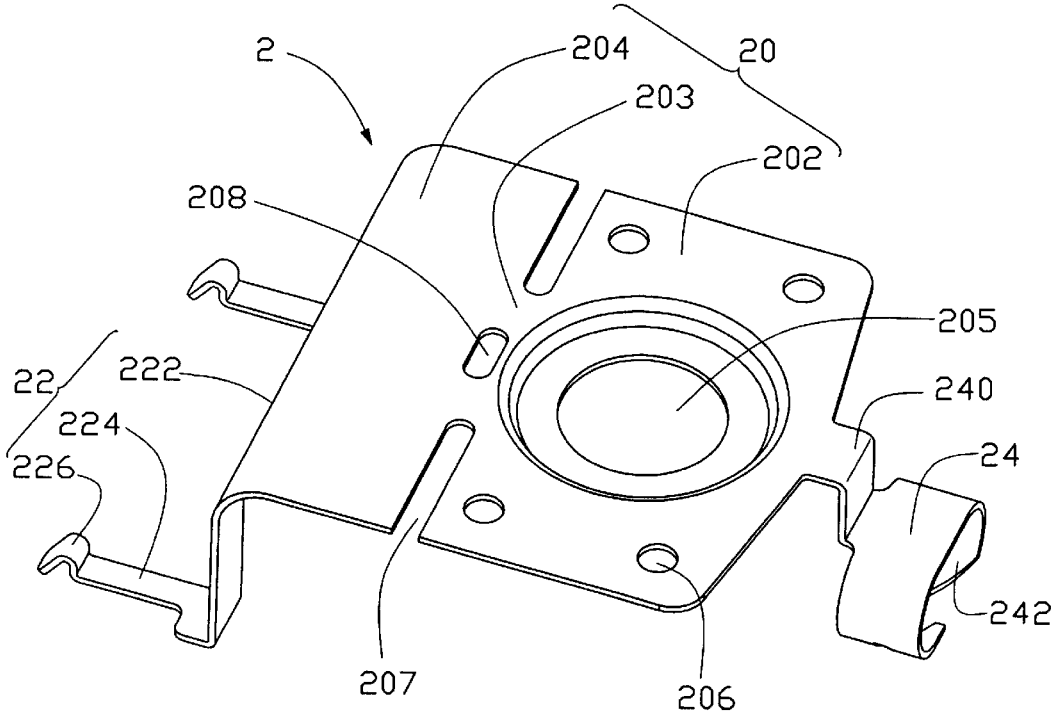
FIG. 2 is a perspective view of a latch mechanism of the plug connector of FIG. 1.

Referring to FIG. 2, the latch mechanism 2 includes a spring plate 20, a latch portion 22 extending from a front end of the spring plate 20, and a crimping tail 24 extending from a rear end of the spring plate 20.

The spring plate 20 includes a support portion 202, an elastic portion 204, and a neck 203 connecting the support portion 202 with the elastic portion 204. A pair of slots 207 is defined in the spring plate 20 on opposite sides of the neck 203 respectively. An aperture 208 is defined in the neck 203, to increase resiliency of the neck 203. A through hole 205 is defined in a middle of the support portion 202. Four positioning holes 206 are defined in four comers of the support portion 202, respectively.

The latch portion 22 has an inverted U-shaped appendage 222 depending from a front edge of the elastic portion 204. A pair of latch arms 224 extends perpendicularly outwardly from free ends of the appendage 222 respectively. A hook 226 is formed at a distal end of each latch arm 224, for latching with the mating connector.

The crimping tail 24 is connected with the spring plate 20 by a connecting arm 240. The connecting arm 240 is L-shaped, and extends rearwardly from a rear end of the support portion 202 of the spring plate 20. The crimping tail 24 comprises an open ring 242 rearward of and connecting with a lower edge of the connecting arm 240. The ring 242 is crimped to secure the cable 31 extended therethrough (see FIGS. 4 and 5).

Figure 3:
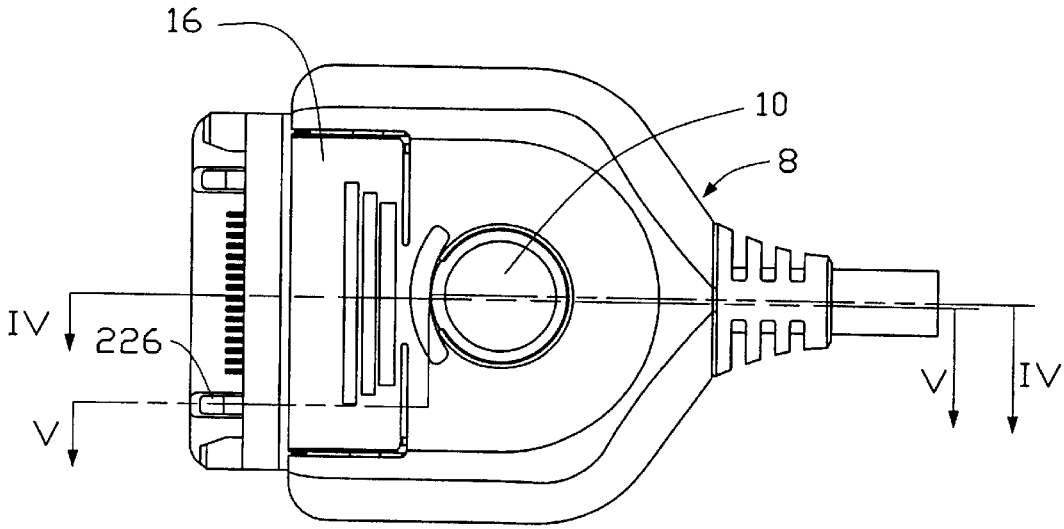
FIG. 3 is a top plan assembled view of the plug connector of FIG. 1.
Figure 5:
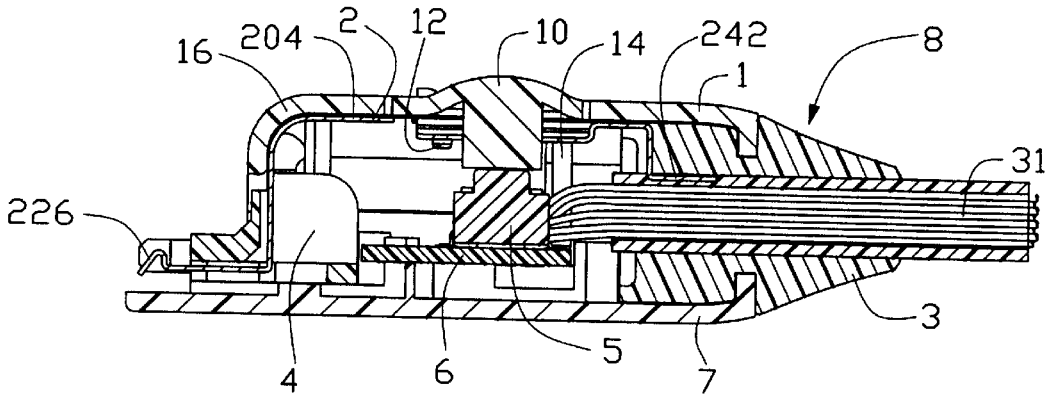
FIG. 5 is a cross-sectional view of the plug connector of FIG. 3, taken along line V—V of FIG. 3.

FIGS. 3, 4 and 5 show different views of the assembled plug connector 8. In assembly, the printed circuit board 6 is placed on the bottom cover 7. The switch 5 is soldered onto the printed circuit board 6. The switch 5 is used to control electrical signal transmission between a first electrical device connected with the cable 31 and a second electrical device connected with the complementary mating connector. When the switch 5 is activated, information stored in the first electrical device is transmitted to the second electrical device, or vice versa. The switch 5 and its application are well known by those skilled in the art, and are not within the inventive scope of the present invention. Thus, detailed description of the switch 5 is omitted herefrom.

The terminal module 4 is placed at a front end of the bottom cover 7. The soldering portions 41 of the terminals 40 are soldered to a lower side of the printed circuit board 6. The contact portions 42 of the terminals 40 project from the plug connector 8, for engaging with the complementary mating connector. The strain relief 3 with the cable 31 is placed on the bottom cover 7. The studs 72 of the bottom cover 7 are fittingly engaged in the receiving holes 34 of the strain relief 3 (see also FIG. 1). The bottom flange 74 of the bottom cover 7 is fittingly engaged in the groove 32 of the strain relief 3.

The latch mechanism 2 is placed on the bottom cover 7. The hooks 226 of the latch mechanism 2 project out from the bottom cover 7. The top cover 1 is mounted on the bottom cover 7. A lower portion of the push button 10 extends through the through hole 205 of the latch mechanism 2 to align with and abut a top of the switch 5. The long and short positioning poles 14, 12 of the top cover 1 pass through the positioning holes 206 to locate the latch mechanism 2 in the plug connector 8. The long positioning poles 14 also abut against the printed circuit board 6. The studs 18 of the top cover 1 are fittingly engaged in the receiving holes 34 of the strain relief 3 (see also FIG. 1). The flange 70 of the top cover 1 is fittingly engaged in the groove 32 of the strain relief 3. When the push button 10 is pressed to activate the switch 5, information can by transmitted between the two devices connected to the plug connecter 8 and the complementary mating connector.

The spring plate 20 of the latch mechanism 2 conforms with the lower face of top cover, and the elastic portion 204 of the latch mechanism 2 is fitted on a lower face of the latch release button 16 of the top cover 1. The crimping tail 24 is fixedly inserted into the strain relief 3. The crimping tail 24 is crimped to securely clamp the cable 31 to the connector 8. Wires of the cable 31 are soldered to the printed circuit board 6 beside the switch 5.

When the plug connector 8 is engaged with the complementary mating connector (not shown), the hooks 226 of the latch mechanism 2 of the plug connector 8 latch with corresponding latch means of the complementary mating connector. When the plug connector 8 is unlatched from the complementary mating connector, the latch release button 16 is pressed downwardly to motivate the elastic portion 204 of the spring plate 20 downwardly relative to the support portion 202. The latch portion 22 thus moves downwardly, and the hooks 226 are unlatched from the latch means of the complementary mating connector.

Although the present invention has been described with reference to a specific embodiment thereof, the description is illustrative and is not to be construed as limiting the invention. Various modifications to the present invention may be made to the preferred embodiment by those skilled in the art without departing from the true spirit and scope of the invention as defined by the appended claims.

I claim:

1. A plug connector, comprising:

a housing including a top cover and a bottom cover, the bottom cover engaging with the top cover, and the top cover having a latch release button;

a printed circuit board located in the housing;

a terminal module located in the housing and having a plurality of terminals therein, the terminals connecting with the printed circuit board;

a latch mechanism located in the housing, the latch mechanism having a spring plate and a latch portion extending downwardly and outwardly from a front end of the spring plate, the spring plate having a support portion, an elastic portion and a neck connecting the elastic portion with the support portion, the elastic portion aligning with the latch release button of the top cover and moving downwardly relative to the support portion when the latch release button is pressed, to thereby release the latch portion from a mating connector;

wherein the latch mechanism further has at least one positioning hole defined in the support portion thereof, the top cover forms at least one positioning pole, and each positioning pole engages within a corresponding positioning hole;

wherein the latch portion of the latch mechanism extends perpendicularly downwardly from a front end of the elastic portion of the spring plate;

wherein the latch portion of the latch mechanism comprises an inverted U-shaped appendage extending perpendicularly downwardly from a front end of the spring plate;

wherein a latch arm extends perpendicularly outwardly from each of two free ends of the appendage, and a hook is formed at a distal end of each latch arm for latching with the mating connector;

wherein the latch mechanism further includes a crimping tail extending outwardly from a rear end of the spring plate, the crimping tail comprising a ring for securing a cable extending therethrough;

further comprising a push button switch mounted on the printed circuit board, and wherein the top cover has a push button extending downwardly from a lower face thereof and aligning with the switch, and the push button extends through a through hole of the latch mechanism to abut against the switch;

further comprising a strain relief securing a cable, the strain relief engaging with an end of the housing.

2. A plug connector, comprising:

a housing including a top cover and a bottom cover, the bottom cover engaging with the top cover, and the top cover having a latch release button;

a printed circuit board located in the housing;

a terminal module mounted in the housing and having a plurality of terminals therein, the terminals connecting with the printed circuit board; and a latch mechanism located in the housing, the latch mechanism having a spring plate and a latch portion extending outwardly from a front end of the spring plate, the spring plate having a support portion, an elastic portion and a neck connecting the support portion with the elastic portion, the latch portion having at least one hook at a front end thereof for engaging with a mating connector, the elastic portion aligning with the latch release button of the top cover and moving downwardly relative to the support portion when the latch release button is pressed, to thereby release each hook from the mating connector;

wherein the latch mechanism further defines at least one positioning hole, the top cover forms at least one positioning pole, and each positioning pole engages within a corresponding positioning hole;

wherein the latch portion of the latch mechanism extends downwardly from a front end of the elastic portion of the spring plate;

wherein the latch portion of the latch mechanism comprises an inverted U-shaped appendage extending downwardly from a front end of the spring plate;

wherein a latch arm extends perpendicularly outwardly from each of two free ends of the appendage, and one hook is formed at a front end of each latch arm;

wherein the latch mechanism further includes a crimping tail extending outwardly from a rear end of the spring plate, the crimping tail comprising a ring for securing a cable extending therethrough;

further comprising a push button switch mounted on the printed circuit board, and wherein the top cover has a push button extending downwardly from a lower face thereof and aligning with the switch, and the push button extends through a through hole of the latch mechanism to abut against the switch;

further comprising a strain relief securing a cable, the strain relief engaging with an end of the housing.

* * * * *